US005653363A

United States Patent [19]

Chang

[11] Patent Number: 5,653,363

[45] Date of Patent: Aug. 5, 1997

[54] PLUNGER SHAFT RETAINER AND TRIGGER RELEASE MECHANISMS FOR USER-SELECTIVE DRIPLESS DRIVE CAULK DISPENSING DEVICES

[76] Inventor: Peter J. Y. Chang, 11001 Petersborough Dr., Rockville, Md. 20852

[21] Appl. No.: 495,800

[22] Filed: Jun. 27, 1995

Related U.S. Application Data

[63] Continuation-in-part of Ser. No. 296,647, Aug. 26, 1994, abandoned, which is a continuation-in-part of Ser. No. 205,655, Mar. 4, 1994, Pat. No. 5,381,931.

[51] Int. Cl.[6] ..... B67D 5/42

[52] U.S. Cl. ..... 222/391

[58] Field of Search ..... 222/325–327, 222/391

[56] References Cited

U.S. PATENT DOCUMENTS

| | | | |
|---|---|---|---|
| 4,081,112 | 3/1978 | Chang | 222/391 |
| 5,197,635 | 3/1993 | Chang | 222/137 X |
| 5,381,931 | 1/1995 | Chang | 222/391 X |

*Primary Examiner*—Gregory L. Huson
*Attorney, Agent, or Firm*—Royal W. Craig

[57] ABSTRACT

Simple and economical drive mechanism controls for incorporation in a manually operated caulking gun. The controls include various restraint springs and reeds to afford the caulk gun user the option of releasing pressure (to avoid drips) or not upon full release of the trigger, and a resistance clip to provide some restraint against the plunger shaft inadvertently sliding backward when the trigger is fully released and pressure is removed in the dripless drive context.

23 Claims, 5 Drawing Sheets

PLUNGER SHAFT RETAINER AND TRIGGER RELEASE MECHANISMS FOR USER-SELECTIVE DRIPLESS DRIVE CAULK DISPENSING DEVICES

CROSS-REFERENCE TO RELATED APPLICATION(S)

The present invention is a continuation-in-part of U.S. Ser. No. 08/296,647, filed Aug. 26, 1994, which application was abandoned on Apr. 25, 1996, and which is a continuation-in-part of Ser. No. 08/205,655, filed Mar. 4, 1994, and issued as U.S. Pat. No. 5,381,931.

FIELD OF THE INVENTION

The present invention relates to dispensing devices and, more particularly, to hand-held caulk guns having a controlled dripless drive mechanism to selectively allow the release of built-up pressure from the caulk cartridge upon release of the trigger.

BACKGROUND OF THE INVENTION

Conventional economy brand caulking guns are generally manual trigger-operated devices incorporating a unidirectional gripping assembly which urges a piston rod forward to eject the compound from a cartridge. One such caulk gun is set forth in U.S. Pat. No. 5,381,931 issued to the inventor named herein for his "Caulk Dispensing Device with Multi-Position Thrust Selection Dial" (shown at FIG. 1). This patent allow the user to vary the leverage obtainable by a hand operated trigger, and insures robust delivery of the composition at a selectable volume and flow rate. The improvement helps to deliver a variety of dense fluid compounds including urethane, vinyl, polyester, epoxy and other plastics or resins.

Although delivery is important, so to is the ability to quickly cut-off delivery. Many of these compounds have other properties such as fast setting times that make them difficult to remove if excessively applied. Consequently, in addition to being robust, the dispensing device must be capable of applying a clean and uniform bead of compound, and this requires tight control over the volumetric flow rate. Optimally, control should be maintained at all times to insure a uniform bead. However, control has previously been lacking when the user wishes to reduce the bead of caulk. To do this, the user releases the trigger. Many prior art caulk guns maintain full pressure when the trigger is released and the bead of caulk continues unabated. Such lack of control can affect the quality of the bead. It is better if pressure is relieved slightly upon initial release of the trigger, momentarily slowing the flow of caulk. However, the plunger must quickly be locked in place to prevent rearward retraction and to allow the user to continue the bead. Control has also previously been lacking when the user wishes to terminate the bead of caulk. Again, the user must release the trigger and then depress a release lever to terminate the bead. This introduces a short lag time after the decision to terminate the bead. Within this lag time of maintained pressure, an unwanted surplus of compound is extruded and a messy and uneven bead often results. It is best if pressure is released upon full release of the trigger, thereby cutting off the flow of caulk.

There have been efforts to achieve this momentary releasing action in the past. For example, U.S. Pat. No. 4,566,610 issued to Herb discloses a dual-cartridge dispensing device utilizing a pair of angled grips 16 (see FIG. 1) which engage a releasing member 19 upon full release of the trigger to thereby remove all driving force and flee the plunger shafts. Unfortunately, the releasing mechanism of Herb '610 is adapted for that particular drive assembly, and the drive assembly is complex and expensive.

U.S. Pat. No. 4,461,407 to Finnegan discloses an automatic pressure relief mechanism for a caulk gun including an annular elastic ring 42 tightly encircling the plunger shaft 8. The ring 42 is held against the interior of housing 21 by a fixed retainer 200. When the trigger 130 is retracted, the plunger shaft 124 is urged forward through the ring 42. Since it is tight, the ring deforms and is partially pulled through the housing wall 21. When the trigger 130 is released, the deformed ring 42 tries to regain its shape, thereby pulling shaft 124 back a bit. This releases pressure, and a dripstop feature is introduced. Despite the advantage, the Finnegan '407 caulk gun has its drawbacks. Specifically, the attachment of the frictional ring 42 to the wall of housing 21 impedes the motion of the plunger shaft 124. The elastic ring 42 becomes the subject of deformation and wear. Moreover, the ring 42 and retainer 200 assembly is rather costly as it requires intricate metal forming (see FIG. 2), welding (column 4, lines 24–26), and a precision-fit elastic ring (see column 4, lines 63–68). These factors escalate the manufacturing costs.

U.S. Pat. No. 5,156,305 to Eyre discloses a drive assembly for a more economical molded-plastic open frame caulk gun. In this open frame type (see FIG. 2), the plunger shaft is slidably carried by two sleeves 28, 30 formed in a molded plastic housing. A downwardly extending trigger 43 is pivoted to the housing and retractable against the handle 46. The trigger 43 includes an upper rivet 45 above the pivot point. The upper rivet 45 bears against a first gripping member 41 that encircles the plunger shaft, and a compression spring 42 rearwardly biases the first gripping member 41 toward the trigger 43. A release lever 51 encircles the plunger shaft and extends upwardly behind the housing to a pivot point. Like Finnegan '407, Eyre '305 also teaches the use of a rod-engaging O-ring bush 52 that relieves pressure upon release of the trigger. In contrast to Finnegan '407, Eyre '305 attaches the bush 52 to the release lever 51 to move therewith (see, also, column 4, lines 18). The plunger shaft fictionally passes through the elastic bush 52. In operation, the release lever 51 with integral bush 52 rides forward on the plunger shaft while the trigger 43 is retracted. When the trigger 43 is first released, the friction of the bush 52 catches the plunger shaft and the release lever 51 is carried backward. The release lever 51 eventually attains a critical angle and engages the plunger shaft to prevent further retraction. However, pressure is released in the meantime, and a dripstop feature is introduced. As did Finnegan '407, Eyre '305 also leaves room for improvement. However, the bush 52 and housing 53 assembly is rather costly as it requires drilling of a hole through the release lever, insertion of the bush 52 in the housing 53, and insertion of the combination into the release lever hole. The additional parts and labor greatly increases manufacturing costs.

The present inventor has in the past developed various mechanisms which would insure an operating range (short of full release) where the plunger shaft cannot retract and pressure is maintained. This way, an operator can selectively keep the trigger within the operating range to apply/maintain pressure and output a uniform bead of caulk. Alternatively, the operator can fully release the trigger to release pressure, end the bead, and stop dripping. However, there remains room for improvement. There are situations where the user may wish to release the trigger yet not remove pressure (to maintain a continuous and even bead of caulk). This ability does not exists with any of the above-described prior art patents. Consequently, it is most desirable to give the user the option of completely disengaging or not upon full release of the trigger. Furthermore, when the trigger is fully released and pressure is removed, the freedom of the plunger shaft to slide has proven to be a safety hazard in certain situations. For example, when the user is atop a ladder doing overhead caulking, it is obviously best if the plunger shaft were restrained against rearward sliding after release of the trigger. The freedom of the plunger shaft also makes it difficult to hang the gun by hooked end of the shaft from a ladder or window sill. The gravity of the gun tends to pull out the plunger shaft. However, any proposed solutions should not effect the incremental extension of the gun and drive efficiency, nor should it escalate the manufacturing costs.

SUMMARY OF THE INVENTION

In accordance with the above, it is an object of the present invention to provide various mechanisms for giving a caulk gun user the option of releasing pressure or not upon full release of the trigger.

It is another object to provide a degree of restraint against the plunger shaft inadvertently sliding backward when it is fully released and pressure is removed, thereby eliminating a potential safety hazard in certain situations.

These and other objects are accomplished in accordance with the present invention, which encompasses various embodiments of a robust drive assembly for manual caulking guns. For the purpose of illustration, the drive assemblies are shown in the context of a conventional caulking gun having a housing (which may be metal enclosure or a single piece molded plastic open frame) with a downwardly extending handle. A plunger shaft is slidably supported in the housing for dispensing caulking composition, and a trigger is pivoted to the housing and retractable against the handle for advancing the plunger shaft.

In a first embodiment, a resistance clip is provided in the form of an annular yoke for encircling the plunger shaft and providing frictional resistance against sliding. The resistance clip may be inserted onto the plunger shaft for inhibiting inadvertent retraction thereof. The free ends of the resistance clip may be flared outwardly to facilitate insertion.

In further embodiments, restraint springs or reeds are attached to the housing at a point immediately preceding the home position of the trigger. The restraint springs or reeds serve to nest the trigger into its home position and counterbalance the force of the compression spring at that point. Consequently, the restraint spring or reeds selectively prevent the trigger from engaging the releasing means when the trigger is released gently, or alternatively allow the trigger to engage the releasing means when said trigger is released quickly. This makes the dripless feature a user-selectable option.

All of the above-described improvements refine the dripless release feature. They are simple and inexpensive to manufacture, yet highly effective. Their simplicity allows them to be manufactured OEM or retrofit for minimal additional cost.

DETAILED DESCRIPTION OF THE PREFERRED EMBODIMENTS

Figure 1:
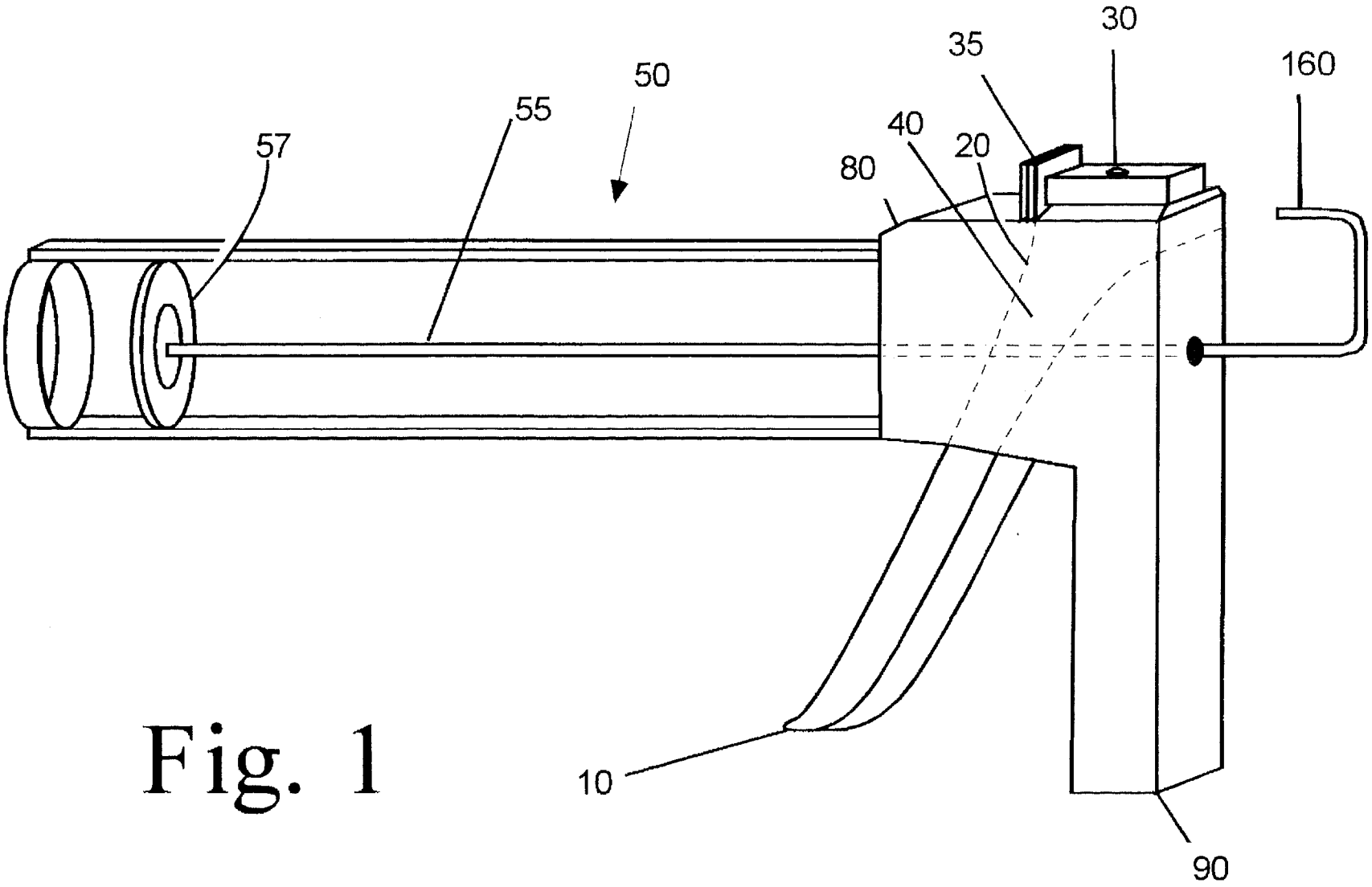
FIG. 1 is a side perspective view of a hand-held caulk gun incorporating a Multi-Position Thrust Selection Dial as described in U.S. Pat. No. 5,381,931 issued to the inventor herein.
Figure 2:
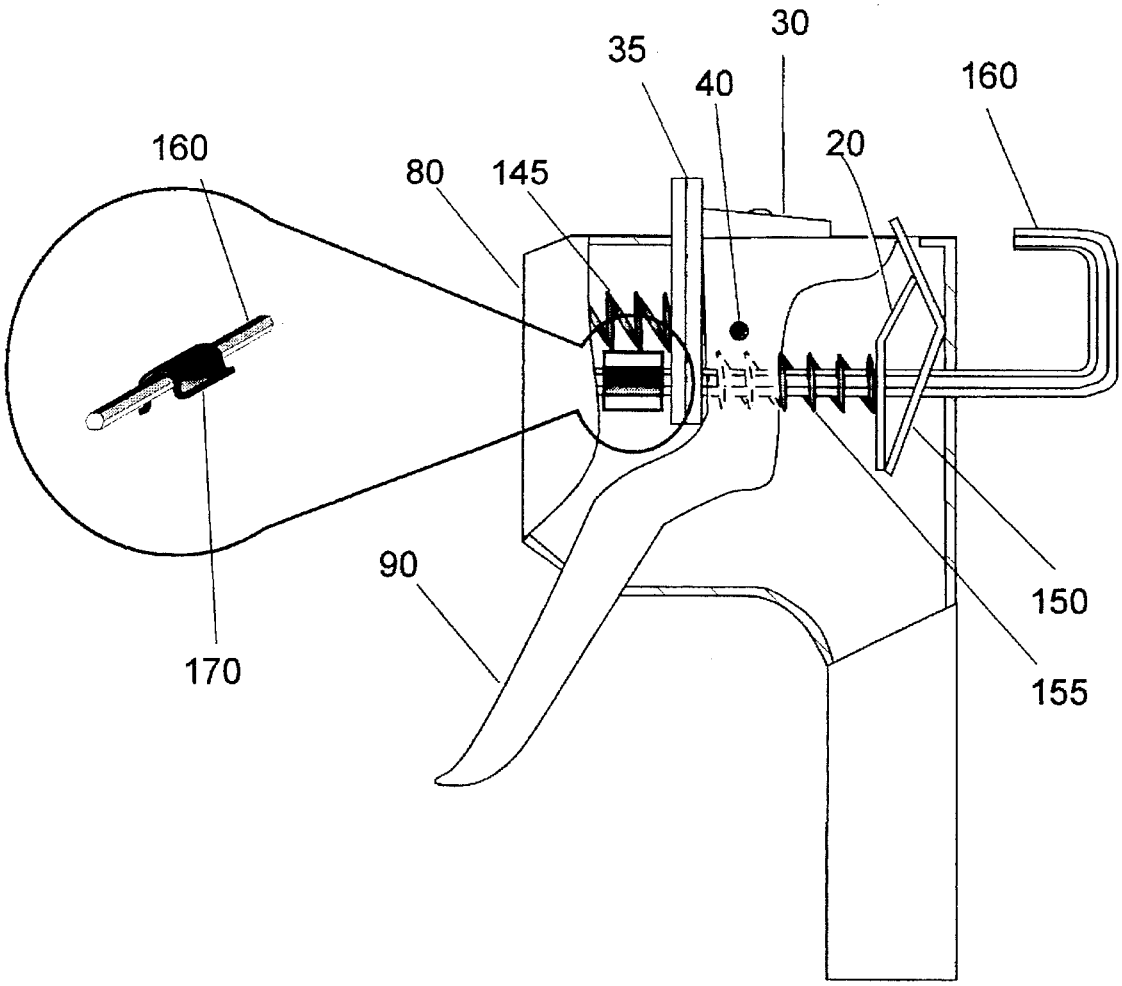
FIG. 2 is a side cut-away view with enlarged bubble illustration of a plunger shaft clip according to one feature of the present invention.

FIG. 2 shows a side cut-away view of a resistance clip 170 according to a first embodiment of the present invention. An enlarged perspective view of the plunger shaft clip 170 is shown to the left in the enlarged bubble illustration.

The resistance clip 170 is a simple and effective improvement for any caulk gun with a drip-stop feature such as shown. The illustrated caulk gun generally includes a forward frame (not shown) for slidably guiding a piston (not shown) mounted at the distal end of a plunger shaft 160. The frame may be adapted for carrying a conventional caulk cartridge, or it may be a refillable barrel-type reservoir for containing loose composition.

Plunger shaft 160 is driven by a plunger drive assembly including a housing 80, and a trigger 90 which is shown pivoted at a screw hinge 40 located above or below plunger shaft 160. An enlarged upper portion of trigger 90 extends past screw hinge 40. An optional multi-position selection dial 30 is also shown pivotally mounted atop trigger 90. Other examples of such multi-position selection dials are disclosed in U.S. Pat. No. 5,381,931 issued to the present inventor.

In forward operation, the trigger 90 is retracted by hand and pivots counterclockwise about screw hinge 40. The multi-position selection dial 30 (or, if omitted, the top edge of the upper portion of trigger 90) bears against a first grip 35 and urges it forward. First grip 35 is a flat elongate metal member having a through-bore near the bottom edge to pass plunger shaft 160. As first grip 35 is biased forward from the top it becomes more angled. Eventually first grip 35 attains a critical angle where it engages plunger shaft 160, and further retraction of trigger 90 is converted into lateral movement of plunger drive shaft 160.

When trigger 90 is released it is return-biased by compression spring 155 and pivots clockwise about pivot 40 to its home position. At the same time, the forward bias is removed from first grip 35, and first grip 35 is return-biased toward an upright position by compression spring 145. As first grip 35 moves to an upright position it releases plunger shaft 160.

It is most desirable to momentarily slow the flow of caulk upon initial release of the trigger, and to completely disengage plunger shaft 160 when the trigger 90 is fully released. This will give a dripless feature for improved control over the bead of caulk. In the context of a caulk gun of the type disclosed in U.S. Pat. No. 5,529,225 issued to the present inventor, the dripless action is provided by a pair of angled grips, including second grip 20 and third grip 150. Both second and third grips 20, 150 are flat elongate metal members with through-bores at their bottom to pass plunger shaft 160. While trigger 90 is retracted, the second grip 20 is biased by spring 155 against third grip 150, and the third grip 150 pivots about its elbow to allow the plunger shaft 160 to fictionally slide through. However, when trigger 90 is released, the third grip 150 pivots about its elbow until its lower length becomes buttressed against the rear of cover 80. The second grip 20 follows until it attains a critical angle whereby it engages plunger shaft 160 to prevent rearward extraction. In the interim before second grip 20 attains the critical angle, the plunger shaft is free to retract. The relief of pressure upon initial release of the trigger momentarily slows the flow of caulk and gives greater control over the bead. Once again, the plunger is quickly locked in place when grip 20 attains its critical angle to prevent rearward retraction and to give the user the option of continuing the bead. It is also advantageous if pressure is released upon full release of the trigger, thereby cutting off the flow of caulk. As trigger 90 is fully released the second grip 20 lessens its bias against third grip 150. The second grip 20 remains locked until the enlarged top portion of trigger 90 contacts the upper extension of third grip 150 and pivots it clockwise. As the third grip 150 is pivoted clockwise it pivots second grip 20 clockwise thereby disengaging plunger shaft 160 and allowing further retraction. Consequently, a dripless feature is provided by removing pressure from the caulk cartridge, thereby cutting off the flow of caulk. The present inventor has anticipated various dripstop mechanisms which have a common problem. When the enlarged top portion of trigger 90 disengages plunger shaft 160 to provide the dripstop feature, the plunger shaft 160 is free to slide within the housing. This causes a safety hazard in certain situations, e.g., where the user is doing overhead work and needs the plunger shaft 160 needs to remain fixed. Otherwise, the shaft 160 might slide free into the user's face, possibly knocking the user from a ladder or otherwise causing injury. FIG. 2 shows a retention clip 170 that prevents this occurrence.

Retention clip 170 is preferably formed from a length of resilient spring metal or plastic. The clip is molded, bent or otherwise contoured to conform to the diameter of the plunger shaft 160. Retention clip 170 is dimensioned to clip around the plunger shaft 160 and to maintain a degree of frictional pressure in order to resist sliding of the shaft 160. The retention clip 70 is not attached to the interior of the housing 80, nor anything at all, but is removably clipped onto the plunger shaft 160 by pressing it with the thumb. In the present embodiment, the retention clip 170 is inserted forwardly of the first grip 35. The length of the retention clip 170 is slightly less than the length of the compression spring 145 when the latter is in a compressed state. This way, clip 170 does not interfere with operation of the drive mechanism. It has been found that a clip 170 that is bent 340° around works well. This leaves a 20° gap for insertion, yet imparts sufficient friction. The free ends of retention clip 170 are flared outwardly to ease insertion onto the plunger shaft 160. Once inserted, the retention clip 160 remains free to slide over the shaft 160 between the front of housing 80 and the first grip 35.

In operation, the retention clip 170 applies a small degree of pressure to plunger shaft 160 and becomes lodged against the first grip 35 to fictionally prevent the plunger shaft 160 from suddenly sliding outward when released by the dripstop mechanism. The degree of friction maintained is small so as not to obstruct forward movement of the plunger shaft 160, and the proper friction can be controlled by adjusting the thickness and dimensions of the clip 170.

Figure 3:
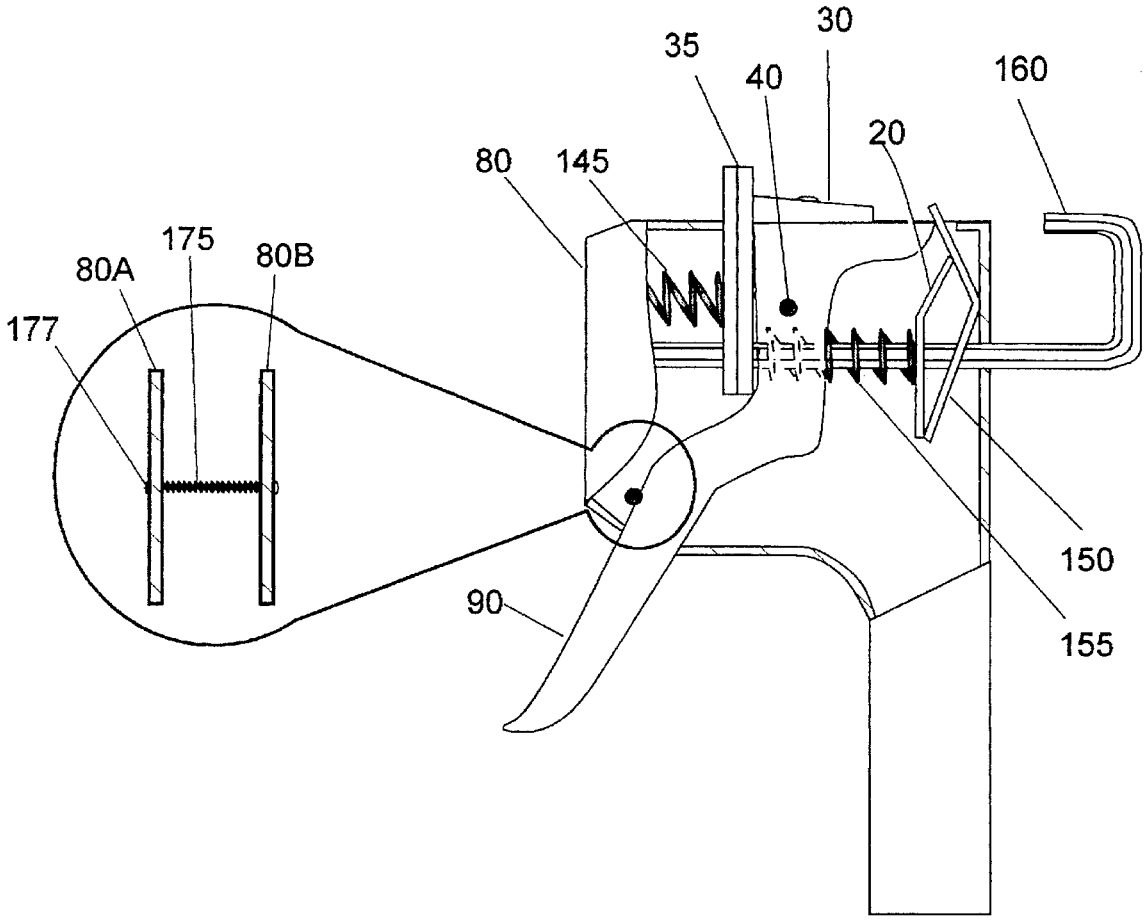
FIG. 3 is a side cut-away view with enlarged bubble illustration of a trigger-stop mechanism according to a second embodiment of the present invention.

FIG. 3 illustrates another dripstop feature in the context of the same caulk gun of U.S. Pat. No. 5,529,225 issued to the present inventor as described above. The feature is a trigger restraint spring 175 comprising a finely-coiled spring attached to the interior of housing 80 in order to span the opposing sidewalls 80*a* and 80*b*. The spring 175 is positioned at a point immediately preceding the fully-released position of trigger 90. Spring 175 may be attached by any conventional means, including rivets 177 as illustrated. Alternatively, the looped end-coils of spring 175 may embrace tabs cut into the side walls 80*a* and 80*b*, or the ends of spring 175 may be riveted or screwed to the sidewalls 80*a* and 80*b*. The positioning of spring 175 relative to the trigger 90 is an essential design constraint. Spring 175 should immediately precede the fully released position of trigger 90. It is intended that the trigger 90 nest in spring 175 upon full release, whereby spring 175 counterbalances the forces of springs 145 and 155.

During forward operation, the trigger 90 is retracted by hand and pivots counterclockwise about screw hinge 40, thereby urging plunger shaft 160 forward in the previously described.

When trigger 90 is released it is return-biased by compression spring 155 and pivots clockwise about pivot 40 to its home position. At the same time, the forward bias is removed from first grip 35, and first grip 35 is return-biased toward an upright position by compression spring 145. As first grip 35 moves to an upright position it releases plunger shaft 160.

It is often desirable to disengage plunger shaft 160 when the trigger 90 is fully released to provide a dripless feature. On the other hand, if the user wishes to maintain a continuous and even bead despite fully releasing the trigger, the pressure should not be fully released. Consequently, it is best to give the user the option of completely disengaging or not upon full release of the trigger. Restraint spring 175 gives the option. Normally, the second grip 20 remains locked until the enlarged top portion of trigger 90 contacts the upper extension of third grip 150 and pivots both grips clockwise. This disengages plunger shaft 160 and allows further retraction (thereby giving the dripless feature). However, the restraint spring 175 is positioned to slightly obstruct the release of trigger 90, selectively preventing the enlarged top portion of trigger 90 from pivoting the upper extension of third grip 150. The obstruction can be overcome at the option of the user. A simple "quick-release" of trigger 90 will result in a sufficient recoiling action to overcome the spring 175, and the third grip 150 will still pivot clockwise to disengage plunger shaft 160 and allow further retraction (thereby giving the dripless feature). However, if the user so chooses, he can gently release trigger 90. This way, trigger 90 nests in restraint spring 175 and fails to overcome it. Spring 175 obstructs the full release of trigger 90, and indeed prevents the enlarged top portion of trigger 90 from pivoting the upper extension of third grip 150. The dripless feature is suppressed at the option of the user to maintain a uniform bead, and the plunger shaft 160 is frictionally prevented from inadvertently sliding outward. This eliminates any safety hazard, e.g., where the user is doing overhead work and needs the plunger shaft 160 to remain fixed. It also allows the user to hang the gun from the ladder.

Figure 4:
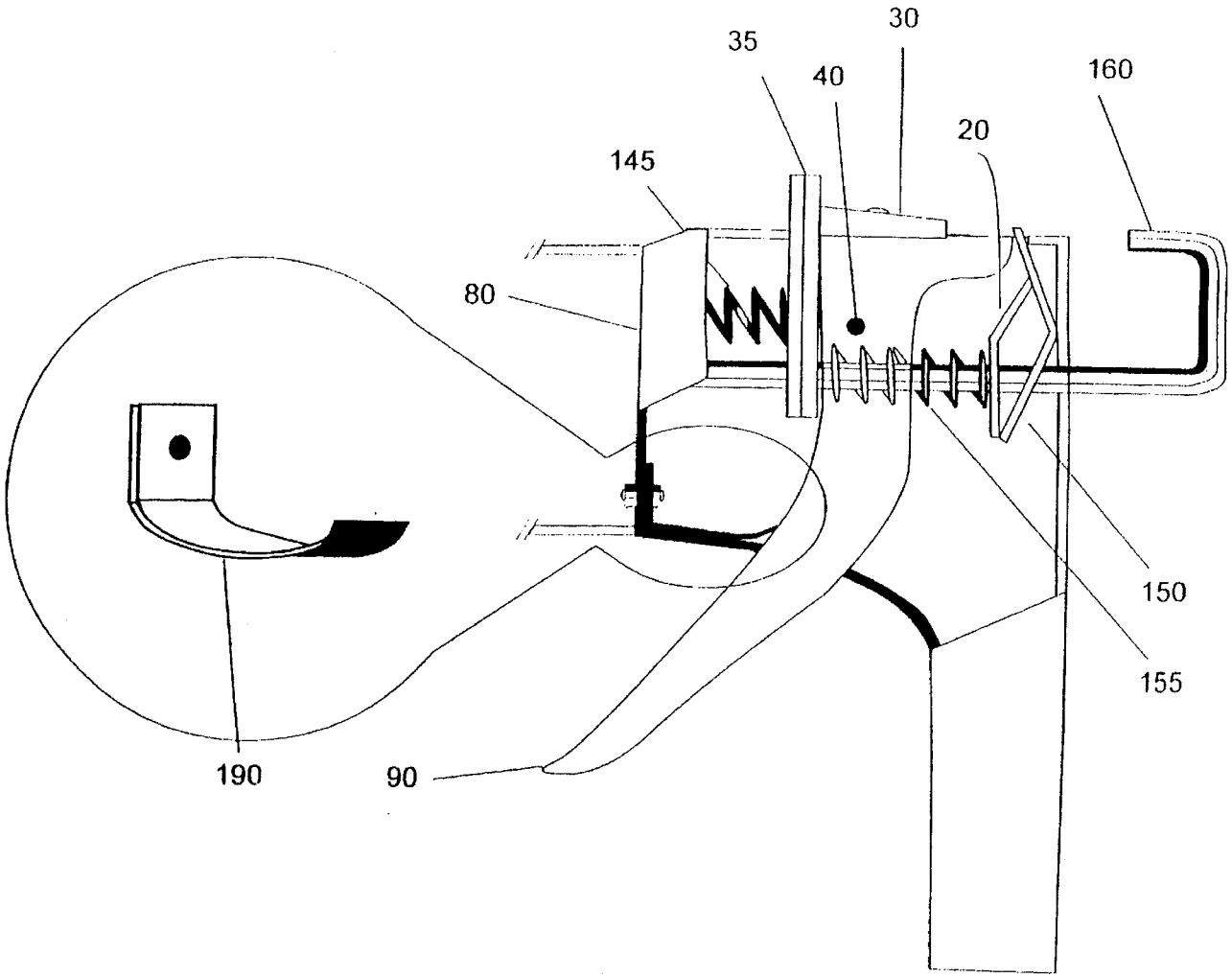
FIG. 4 is a side cut-away view with enlarged bubble illustration of a trigger-stop mechanism according to a third embodiment of the present invention.
Figure 5:
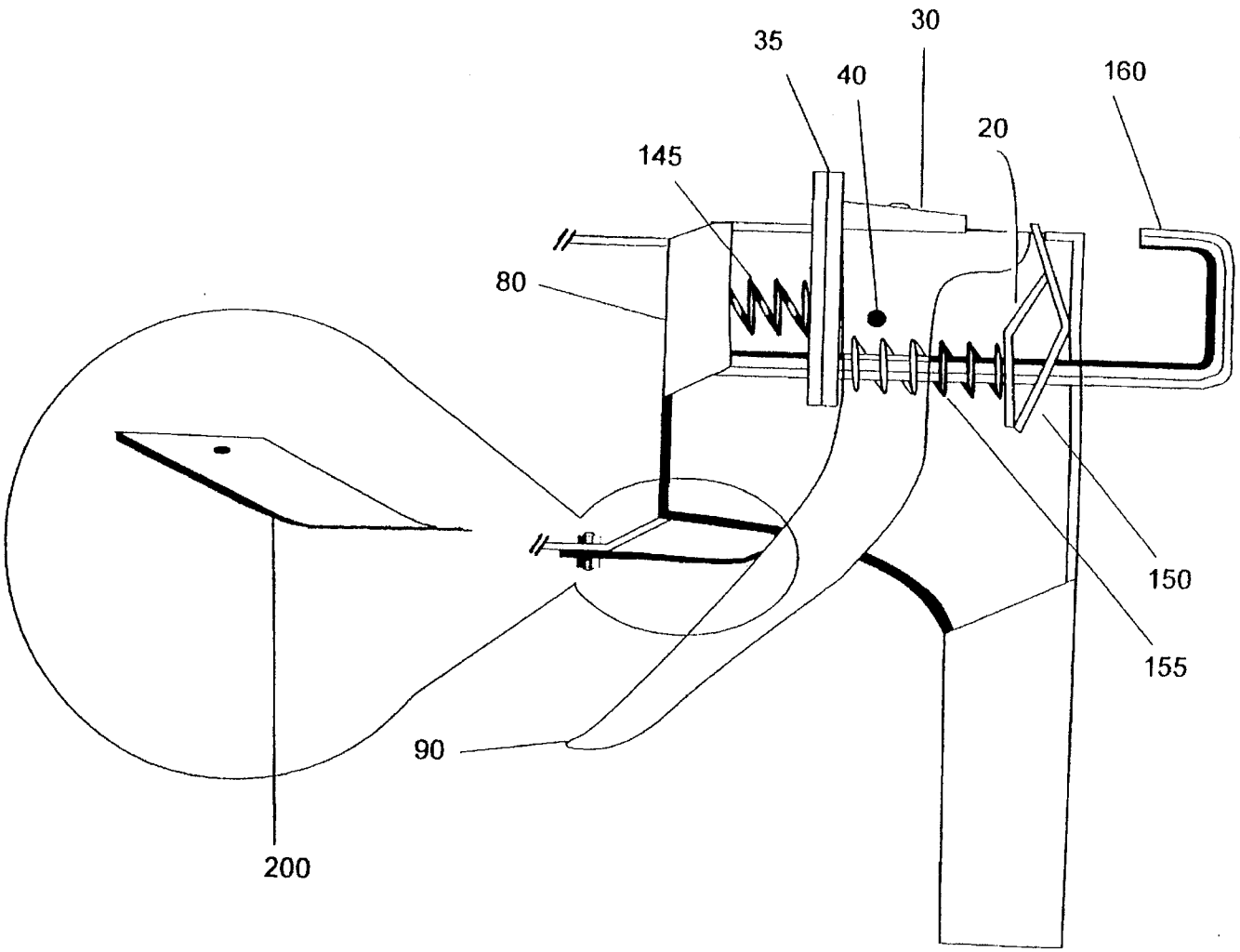
FIG. 5 is a side cut-away view with enlarged bubble illustration of a trigger-stop mechanism according to a fourth embodiment of the present invention.

FIGS. 4 and 5 illustrate two alternative mechanisms for accomplishing the same purpose as the restraint spring 175 of FIG. 3.

The embodiment shown in FIG. 4 employs an angled strut 190 formed of metal, plastic or any other durable yet resilient material. In the illustrated embodiment, the upwardly protruding length of strut 190 is equipped with a bore-hole by which it is secured to the front wall of housing 80 by conventional screws. Alternatively, strut 90 could be secured by conventional spot-welding, rivets, or the like. The horizontal length of strut 190 protrudes toward the trigger 90. Preferably, the end of the horizontal length of strut 190 is bowed or beveled upward so that it will ride up the length of the trigger 90 when contact is made therewith. Strut 190 provides the same measure of obstruction as the restraint spring 175 described above. More specifically, strut 190 is positioned to slightly obstruct the release of trigger 90, selectively preventing the enlarged top portion of trigger 90 from pivoting the upper extension of third grip 150. The obstruction can be overcome at the option of the user. A simple "quick-release" of trigger 90 will result in a sufficient recoiling action to overcome the strut 190, and the third grip 150 will still pivot clockwise it disengages plunger shaft 160 and allow further retraction (thereby giving the dripless feature). However, if the user so chooses, he can gently release trigger 90. This way, trigger 90 fails to overcome the strut 190. Strut 190 obstructs the full release of trigger 90, and indeed prevents the enlarged top portion of trigger 90 from pivoting the upper extension of third grip 150. Once again the dripless feature is suppressed, and the sliding out of the plunger shaft 160 is prevented.

FIG. 5 shows yet another embodiment of a strut 200 similar to that of FIG. 4 except that it is better adapted for retrofit attachment to the frame 50 of an existing caulk gun. The strut 200 is not angled, but extends substantially straight outward to a bowed or beveled end. In the illustrated embodiment, the end of strut 200 is secured to the frame 50 by conventional screws 210. However, it should be noted that rivets or spot welding may be used rather than screws. The operation of the strut 200 of FIG. 5 is identical to that shown and described with regard to FIG. 4.

Having now fully set forth a detailed example and certain modifications incorporating the concept underlying the present invention, various other modifications will obviously occur to those skilled in the art upon becoming familiar with said underlying concept. It is to be understood, therefore, that within the scope of the appended claims, the invention may be practiced otherwise than as specifically set forth herein.

I claim:

1. An improvement for a caulking gun of the type having a frame and an enclosed housing with a downwardly extending handle, a plunger shaft slidably supported in said frame and said housing for dispensing caulking composition, and a drive mechanism supported in said housing for advancement of said plunger shaft, said drive mechanism further including a trigger pivoted to said housing and retractable against said handle, gripping means for engagement with said trigger and advancement of said plunger shaft when said trigger is retracted, and a compression spring rearwardly biasing said trigger toward a home position, the improvement comprising:

a resistance clip formed in an annular yoke for encircling said plunger shaft and providing frictional resistance against sliding, said resistance clip being inserted onto said plunger for inhibiting inadvertent retraction of said plunger shaft.

2. The improvement of claim 1, wherein said resistance clip is formed from a length of resilient spring steel.

3. The improvement of claim 2, wherein said resistance clip may be inserted onto said plunger shaft forwardly of said gripping means, and there remains free to frictionally slide along said plunger shaft between said housing and gripping means.

4. The improvement of claim 2, wherein said resistance clip imparts a slight frictional resistance against rearward retraction of said plunger shaft.

5. The improvement of claim 4, wherein said resistance clip is formed in an approximate 340° annular yoke leaving approximately a 20° gap for insertion onto said plunger shaft.

6. The improvement of claim 4, wherein the free ends of said resistance clip are flared outwardly to facilitate insertion onto said plunger shaft.

7. An improvement for a caulking gun of the type having a frame and an enclosed housing with a downwardly extending handle, a plunger shaft slidably supported in said frame and said housing for dispensing caulking composition, and a drive mechanism supported in said housing for advancement of said plunger shaft, said drive mechanism further including a trigger pivoted to said housing and retractable against said handle, gripping means for engagement with said trigger and advancement of said plunger shaft when said trigger is retracted, a compression spring rearwardly biasing said trigger toward a home position, and a releasing mechanism engageable with said trigger for release of said plunger shaft and of caulking pressure, the improvement comprising:

a restraint spring attached interiorly of said housing and traversing said housing walls at a point preceding the home position of said trigger, said restraint spring serving to nest said trigger into its home position and counterbalance the force of said compression spring when said trigger is in its home position;

whereby said restraint spring selectively prevents the trigger from engaging the releasing means when said trigger is released gently, and allows the trigger to engage the releasing means when said trigger is released quickly, thereby providing a user-selectable dripless feature.

8. The improvement of claim 1, wherein said restraint spring is formed from a length of resilient spring attached at both ends across sidewalls of said housing.

9. The improvement of claim 2, wherein said restraint spring is attached at the ends by screws.

10. The improvement of claim 2, wherein said restraint spring is attached at the ends by rivets.

11. The improvement of claim 2, wherein the sidewalls of said housing are perforated to form anchor posts for attachment of the coiled ends of said restraint spring.

12. An improvement for a caulking gun of the type having a frame and an enclosed housing with a downwardly extending handle, a plunger shaft slidably supported in said frame and said housing for dispensing caulking composition, and a drive mechanism supported in said housing for advancement of said plunger shaft, said drive mechanism further including a trigger pivoted to said housing and retractable against said handle, gripping means for engagement with said trigger and advancement of said plunger shaft when said trigger is retracted, a compression spring rearwardly biasing said trigger toward a home position, and a releasing mechanism engageable with said trigger for release of said plunger shaft and of caulking pressure, the improvement comprising:

a resilient strut member attached to said housing in advance of said trigger and protruding toward said trigger for engagement therewith at a point immediately preceding the home position of said trigger, said strut serving to nest said trigger into its home position and counterbalance the force of said compression spring when said trigger is in its home position;

whereby said strut spring selectively prevents the trigger from engaging the releasing means when said trigger is released gently, or allows the trigger to engage the releasing means when said trigger is released quickly, thereby providing a user-selectable dripless feature.

13. The improvement of claim 12, wherein said strut is formed from a length of resilient spring steel.

14. The improvement of claim 13, wherein said strut is formed with a beveled end for engagement with said trigger and for slidably riding up on said trigger during release thereof.

15. The improvement of claim 13, wherein said strut is formed with an upwardly bowed end for engagement with said trigger and for slidably riding up on said trigger during release thereof.

16. The improvement of claim 13, wherein said strut is formed with a right angle for attachment to a front wall of said housing.

17. The improvement of claim 16, wherein said strut is attached by screws through said strut and housing.

18. The improvement of claim 16, wherein said strut is attached by rivets through said strut and housing.

19. The improvement of claim 18, wherein said strut is attached by spot welding to said housing.

20. The improvement of claim 13, wherein said strut is formed substantially straight for attachment to said frame exteriorly of said housing.

21. The improvement of claim 20, wherein said strut is attached by screws through said strut and frame.

22. The improvement of claim 20, wherein said strut is attached by rivets through said strut and frame.

23. The improvement of claim 20, wherein said strut is attached by spot welding to said frame.

* * * * *